United States Patent [19]

Pullen

[11] 3,994,222

[45] Nov. 30, 1976

[54] INK ROLLER VIBRATOR MECHANISM

[75] Inventor: Donald A. Pullen, Elmhurst, Ill.

[73] Assignee: Rockwell International Corporation, Pittsburgh, Pa.

[22] Filed: Apr. 30, 1976

[21] Appl. No.: 681,848

[52] U.S. Cl. ..... 101/349; 101/DIG. 14

[51] Int. Cl.[2] ..... B41F 31/14

[58] Field of Search..... 101/DIG. 14, 349, 350, 101/351, 352, 206, 207, 208, 209, 148

[56] References Cited

UNITED STATES PATENTS

| | | | |
|---|---|---|---|
| 1,741,414 | 12/1929 | Graf | 101/DIG. 14 |
| 2,039,867 | 5/1936 | Zuckerman | 101/DIG. 14 |
| 2,506,778 | 5/1950 | Crafts et al. | 101/DIG. 14 |
| 2,581,687 | 1/1952 | McWhorter | 101/DIG. 14 |

*Primary Examiner*—J. Reed Fisher

[57] ABSTRACT

A vibrator mechanism for axially reciprocating the ink drums of a rotary printing press inking mechanism in predetermined phase relationship consists of coacting inner and outer eccentrics that are telescoped over each other and over a common drive shaft. The inner eccentric is releasably connected to the drive shaft so that it can be adjusted angularly about the drive shaft relative to the outer eccentric from a remote, conveniently accessible position to thereby vary the amplitude of the reciprocating motion imparted to the ink drums and the outer eccentric is connected to the drive shaft for positive rotation therewith by means which permit it to shift angularly and radially relative to the drive shaft to accommodate the angular adjustments of the inner eccentric.

7 Claims, 6 Drawing Figures

INK ROLLER VIBRATOR MECHANISM

BACKGROUND OF THE INVENTION

In the design of inking mechanisms for rotary printing presses it is the practice to provide means for vibrating or axially reciprocating the ink drums to thereby more effectively distribute the ink into a uniform, thin film prior to its reaching the printing plate. Various types of vibrating mechanisms have been devised in the past, most of which have proved to be relatively effective for the purpose. However, the known devices are relatively complex and thus expensive to manufacture and maintain. Moreover, most of the devices are difficult and time consuming to adjust for the purpose of varying the amplitude of the reciprocating motion because they are fully enclosed in oil tight compartments and are only accessible by removing cover plates from the frame. A further disadvantage resides in the fact that a separate adjustment must be effected for each ink drum.

SUMMARY OF THE INVENTION

The present invention pertains to an improved ink drum vibrator mechanism which is intended to overcome the disadvantages of the known mechanisms and which is relatively simple and inexpensive to manufacture and maintain. It consists essentially of a drive shaft, a first or inner eccentric which is telescoped over the drive shaft, a second or outer eccentric which is telescoped over the first eccentric, and strap means mounted about the outer eccentric for transmitting reciprocating motion to one or more ink drums as the drive shaft and eccentrics rotate. The inner eccentric is provided with an axially extending sleeve which projects to a point conveniently adjacent an access door on the frame and it is releasably connected to the drive shaft so that it can be angularly adjusted to thereby vary the amplitude of reciprocation of the ink drums. The outer eccentric also is connected directly to the drive shaft for positive rotation therewith by flexible means which permit to shift angularly and radially relative to the drive shaft in order to accommodate the adjustments of the inner eccentric and one simple adjustment of the inner eccentric serves to adjust all of the ink drums simultaneously while maintaining their predetermined phase relationship.

DETAILED DESCRIPTION

Figure 1:
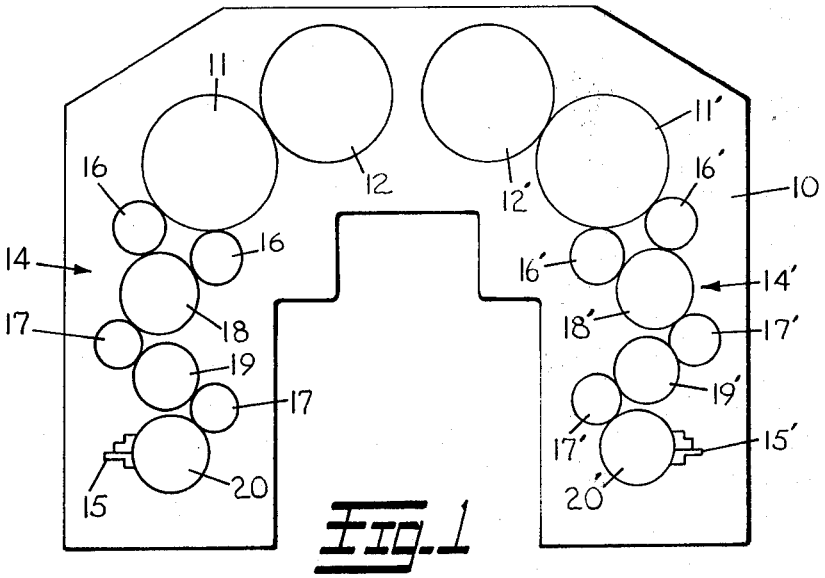
FIG. 1 is a schematic side elevational view of a rotary printing press in which the invention is particularly applicable.

With reference now to FIG. 1 of the drawings, the invention is illustrated, merely by way of example, as embodied in a unit of a rotary web newspaper press which has spaced apart, inverted U-shaped side frames 10 for supporting two printing couples each of which comprises a plate cylinder 11–11′ and a coacting impression cylinder 12–12′. The side frames also provide support for the respective inking mechanisms 14–14′ which serve to convey ink from a source thereof, such as an ink rail 15–15′, to printing plates on the plate cylinder 11–11′ when the press is in operation. In the present instance, each inking mechanism includes a pair of form inking rollers 16–16′, ink transfer rollers 17–17′ and a series of ink drums 18–18′ 19–19′ and 20–20′, the latter often being referred to as an ink feed drum.

The form inking rollers 16–16′ and the ink transfer rollers 17–17′ are journalled for free rotation in sockets supported on the side frames so that they can be adjusted relative to the plate cylinder 11–11′ and the coacting ink drums 18–18′, 19–19′ and 20–20′ so as to convey the ink through the respective roller nips from the rail 15–15′ to the plate cylinder 11–11′. The ink drums 18–18′, 19–19′ and 20–20′ on the other hand, are mounted in the side frames 10 for rotation about fixed axes and they are adapted to be positively driven from the main press drive by gear means including the spur gears 21, 22 and 23 which are secured to the respective drum shafts 24, 25 and 26, see FIG. 3. In addition to their rotary motion, the ink drums also are adapted to be vibrated axially so as to more uniformly distribute the ink into a thin film prior to its reaching the plate cylinder and for this reason they are journalled in suitable bearing means such as are indicated at 27, 28 and 29, respectively, in the side frame 10. Although only the drive ends of the ink drums are shown in FIG. 3, it will be understood that the opposite ends thereof are similarly journalled in the other spaced side frame.

Figure 2:
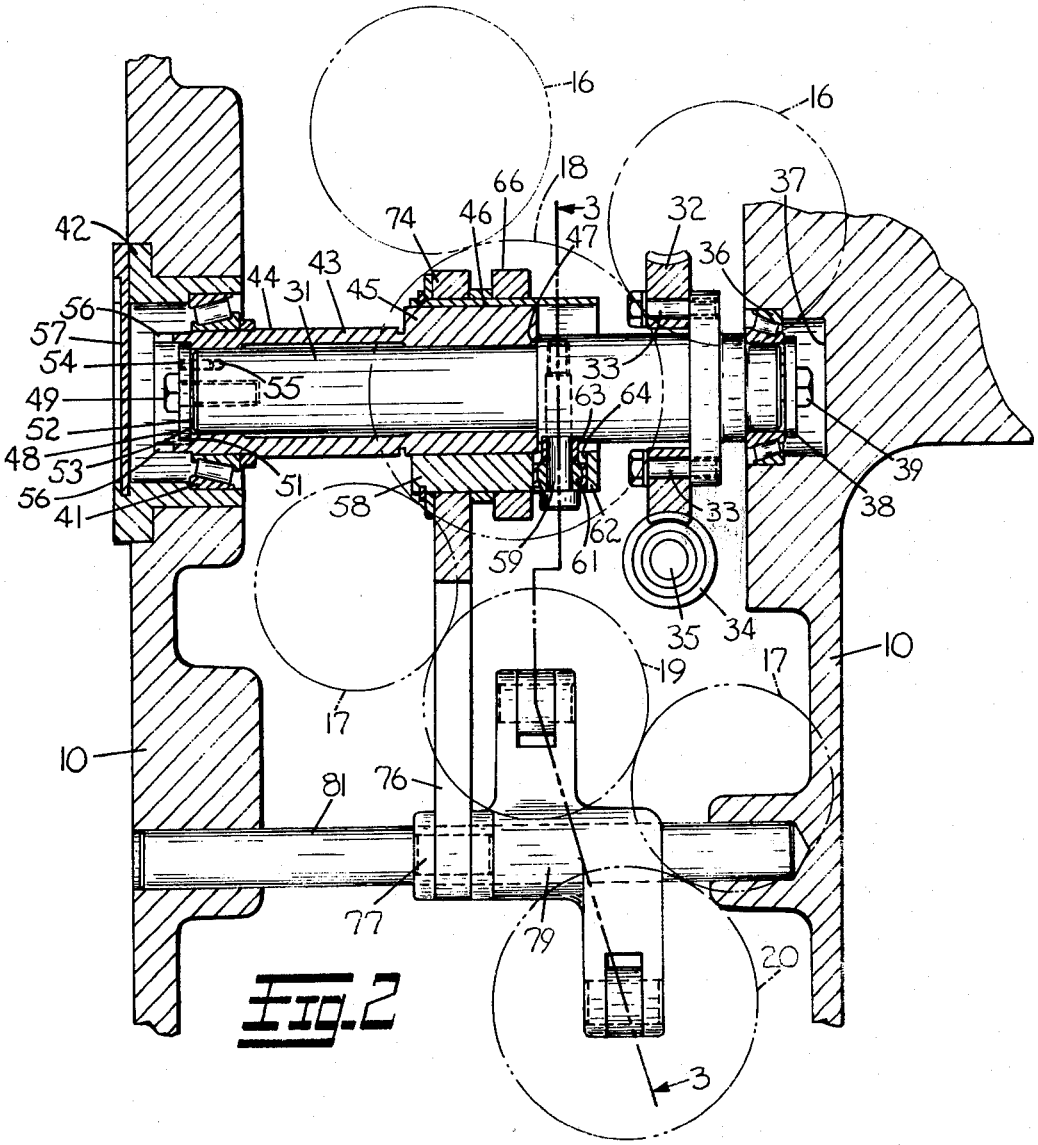
FIG. 2 is an enlarged side elevational view in section and illustrating the vibrator mechanism for the ink drums on one side of the press illustrated in FIG. 1.
Figure 3:
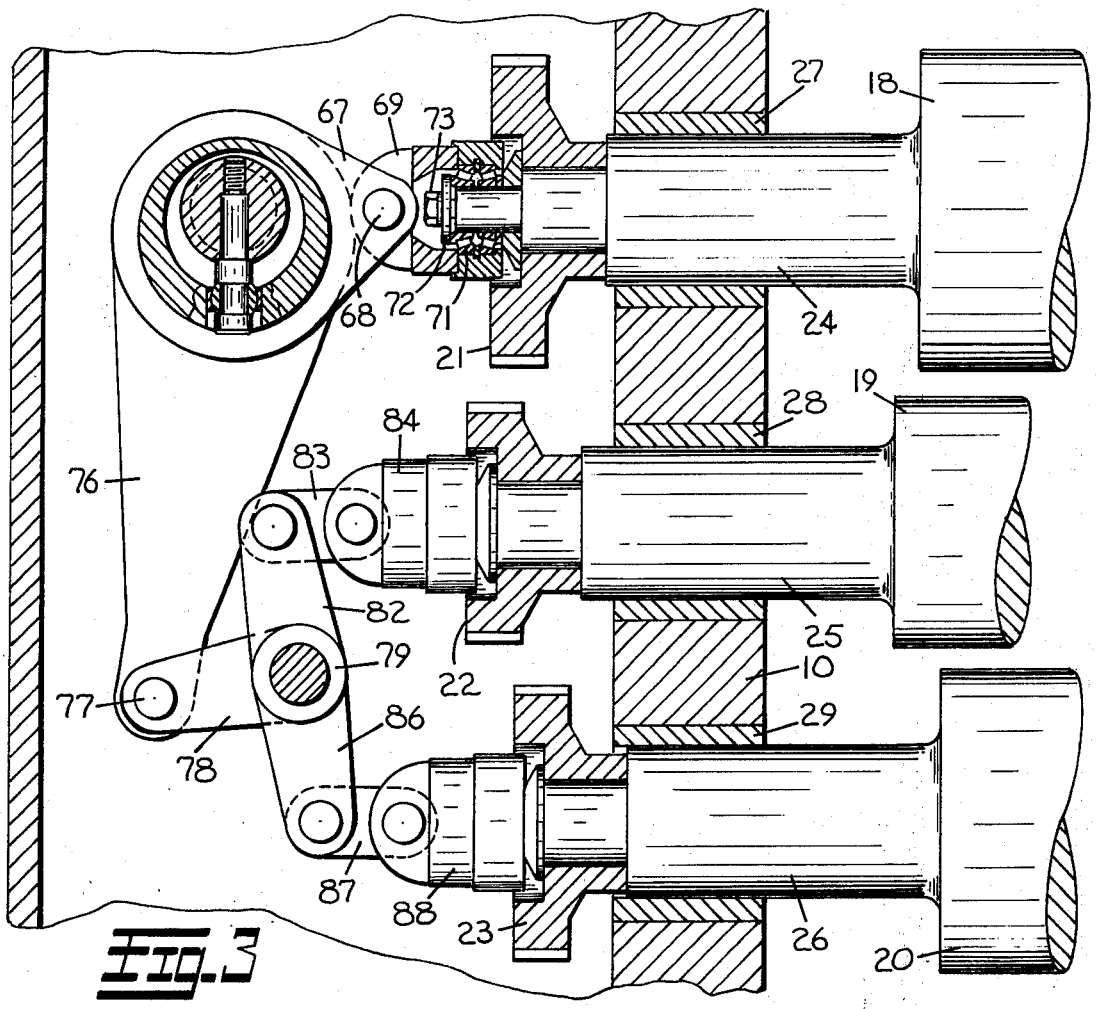
FIG. 3 is a sectional view taken substantially along line 3—3 of FIG. 2.

The mechanism for vibrating the ink drums is best shown in FIGS. 2 and 3 and although these Figures illustrate only the vibrator mechanism for the drums 18, 19 and 20 of the inking mechanism 14 on the left side of the press unit as viewed in FIG. 1, it will be understood that a substantially identical mechanism is provided for the inking mechanism 14′ on the right side.

As illustrated, the vibrator mechanism is located within an oil tight compartment formed on the side frame 10 closely adjacent to the ends of the shafts 24, 25 and 26 of the respective ink drums and it is comprised of a drive shaft 31 which is mounted for rotation about a fixed horizontal axis that is substantially coincident with the axis of the ink drum 18. The drive shaft 31 is arranged to be driven by a worm gear 32 that is secured to the shaft by means of bolts 33 and this gear is adapted to mesh with a worm 34 on the shaft 35 that is driven by the press drive mechanism.

At one end thereof the drive shaft 31 is journalled for rotation in a bearing 36 that is seated in a socket 37 in a wall of the side frame 10 and which is secured on the end of the drive shaft by means of a retainer 38 and bolt 39. The other end of the drive shaft is mounted for rotation in a bearing 41 that is seated in a housing 42 located in another wall of the side frame 10. Actually, the said other end of the drive shaft is supported for rotation in the bearing 41 by means of a sleeve 43 which has a peripheral surface 44 that is concentric with the drive shaft and which sleeve is formed integral with and projects axially from a main body portion 45 having a peripheral surface 46 that is eccentric with respect to the drive shaft axis.

The sleeve 43 and body portion 45 are telescoped over the drive shaft 31 with a snug sliding fit and they are secured in position thereon between a shoulder 47 on the shaft and a circular disc 48 that is attached to the end of the shaft by means of a bolt 49. The disc 48 has a diameter greater than that of the drive shaft so that it will fit within the projecting end of the sleeve 43 and seat against an internal shoulder 51 formed in the sleeve. The shoulder 51 is located at a point in the sleeve that is slightly beyond the end of the drive shaft so that a small gap 52 is provided between the disc 48 and the end face 53 of the drive shaft. Consequently, when the bolt 49 is tightened, the sleeve 43 and eccentric 45 will be compressed between the shoulder 47 and the disc 48 and will thus rotate with the shaft. One or more pins 54 are provided in the disc 48 to be slidably received in recesses 55 formed in the end face 53 of the drive shaft to insure that the disc will rotate therewith when in operation and yet permit the disc to move axially to lock and release the sleeve 43 relative to the drive shaft 31.

When the bolt 49 is loosened it will be evident that the sleeve 43 and eccentric 45 will be released from the drive shaft 31 so that the eccentric 45 can be adjusted angularly relative to the drive shaft. Such adjustments are effected by means of a tool that is adapted to engage the diametrically opposite slots 56 formed in the end of the sleeve 43 and which are readily accessible through a sliding door 57 mounted in the bearing housing 42.

A second or outer eccentric 58 is telescoped over the inner eccentric 45 also with a snug sliding fit. The outer eccentric 58 is somewhat longer than the inner eccentric 45 so that it projects axially beyond the end of the latter and it is connected to the drive shaft 31 for positive rotation therewith by means of a bolt 59 which is threaded into a tapped hole in the drive shaft in a manner that the headed end of the bolt projects radially beyond the peripheral surface of the drive shaft. A uni-ball assembly consisting of the spherical member 61 and race member 62 is mounted on the bolt and retained adjacent the head thereof by means of a spacer 63 and the race member 62 is adapted to fit slidably within a circular opening 64 provided therefor in the portion of the outer eccentric which extends beyond the end of the inner eccentric.

The outer eccentric 58 is thus positively connected to the drive shaft for rotation therewith but is enabled to shift radially and angularly relative to said shaft to accommodate angular adjustments of the inner eccentric 45.

Reciprocating motion is imparted to the ink drum 18 upon rotation of the drive shaft 31 by means of a strap 66 which is rotatably mounted about the outer eccentric 58. This strap has an arm 67 which is connected by means of a pivot pin 68 to a cap member 69 mounted on the end of the drum shaft 24. The cap member 69 is adapted to fit over a bearing 71 secured on the shaft 24 by means of the washer 72 and bolt 73 whereby the shaft 24 and ink drum 18 will be free to rotate relative to the cap member 69, but will be caused to reciprocate axially therewith upon rotation of the eccentrics 45 and 58 with the drive shaft 31.

A second strap 74 also is mounted for rotation about the outer eccentric 58 and it is provided with an arm 76 that is normally disposed at an angle of about 90° with respect to the arm 67 of strap 66. Arm 76 is pivotally connected at 77 to the arm 78 of a bell crank 79 that is rotatably mounted on a horizontal shaft 81 that is secured in openings provided therefor in the walls of the side frame 10. The shaft 81 is located below the drive shaft 31 with its axis parallel thereto. A second arm 82 of the bell crank 79 is pivotally connected by means of a link 83 to the cap member 84 rotatably mounted on the end of the shaft 25 of the ink drum 19 and a third arm 86 of said bell crank 79 is similarly connected by a link 87 to the cap member 88 on the end of the shaft 26 of the ink drum 20.

It will thus be seen that as the drive shaft 31 and therewith the inner and outer eccentrics 45 and 58, respectively, are rotated, the straps 66 and 74 will be actuated and through the arms 67 and 76 thereof reciprocating motion of predetermined amplitude will be imparted to all three of the ink drums 18, 19 and 20. Because of the angular disposition of the arms 67 and 76, the reciprocating motion of the drums 19 and 20 will be out of phase with the motion of the drum 18 and, moreover, because the arms 82 and 86 of the bell cranks 79 are oppositely disposed, the motions of the drums 19 and 20 will be out of phase with one another to provide maximum ink distribution.

The maximum extent of reciprocation of the ink drums will of course depend upon the eccentricity of the inner and outer eccentrics which may be fabricated to suit specific conditions. In general, however, the vibrating mechanisms are adapted to impart reciprocation to the drums which is variable between substantially zero to approximately an inch and one half. Such adjustment of the amplitude of reciprocation is necessary to accommodate various printing requirements and with the present mechanism, one simple and conveniently accessible adjustment serves to vary the amplitude of reciprocation of all of the ink drums simultaneously and without disturbing their phase relationship.

Figure 6:
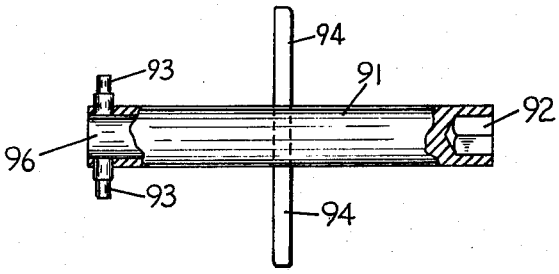
FIG. 6 illustrates a tool for releasing and adjusting the angular position of the inner eccentric.

In accordance with the invention, the vibrator mechanism is adjustable by means of a special wrench as illustrated in FIG. 6 which is comprised of a cylindrical body member 91 having formed in one end thereof a hexagonal socket 92 to fit the bolt head 49. The opposite end of the body member 91 is provided with radially projecting arms 93 to interlock with the slots 56 in the end of the sleeve 43 and arms 94 are provided intermediate the ends of the body member 91 for leverage purposes.

When an adjustment is to be made, the door 57 on the housing 42 is displaced upwardly and the socket end 92 of the wrench is inserted to fit over the bolt 49 at the end of the drive shaft 31 and the bolt is loosened. This relieves the pressure of the washer 48 on the shoulder 51 of the sleeve 43 so that the latter is unlocked from the shaft 31. The wrench is then reversed and the projecting arms 93 at the opposite end thereof are inserted into the slots 56 at the end of the sleeve 43. It will be noted that the end of the body member 91 is hollowed out at 96 to accommodate the head of the bolt 49 which serves to support the end of the wrench and maintain the arms 93 accurately centered in the slots 56 while an adjustment is being effected.

By turning the wrench in this position the sleeve 43 and therewith the inner eccentric 45 can be adjusted angularly relative to the shaft 31 and the outer eccentric 58 to either increase or decrease the extent of reciprocation of all of the ink drums 18, 19 and 20 simultaneously and without disturbing their phase relationship. Once the adjustment has been effected, the wrench is again reversed and the hexagonal socket end 92 is used to tighten the bolt 49 and thereby secure the sleeve 43 and inner eccentric 45 to the drive shaft 31.

Although none has been shown in the drawings, it will be appreciated that suitable indicia can be provided on the washer 48 and the end of the sleeve 43 so that precise and exact adjustments can be effected very simply and with a minimum amount of time.

It will be apparent that when the inner eccentric 45 is adjusted relative to the outer eccentric 58, the latter will be shifted both radially and angularly relative to the drive shaft 31 and yet the outer eccentric 58 must be positively connected to the drive shaft for rotation therewith. Such flexibility is provided by the bolt 59 and uni-ball assembly 61, 62 as will be clearly evident from FIGS. 3, 4 and 5.

FIG. 3 illustrates the vibrator mechanism in the position for maximum reciprocation of the ink drums with the axes of the inner eccentric, the outer eccentric and the drive shaft being aligned in a common plane and each being spaced from the other. In this position the uni-ball assembly 61, 62 is adjacent the inner end of the circular opening 64 in the outer eccentric 58.

Figure 4:
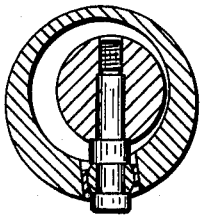
FIGS. 4 and 5 are views depicting different angular positions of the eccentrics.

In FIG. 4, the inner eccentric has been turned approximately 90° from the FIG. 3 position and the outer eccentric 58 has shifted both angularly and radially relative to the drive shaft 31. The uni-ball assembly 61, 62 obviously accommodates the angular change by corresponding pivoting of the race member 62 about the ball member 61 and the radial change in accommodated by the race member sliding in the opening 64 to approximately a mid position therein.

Figure 5:
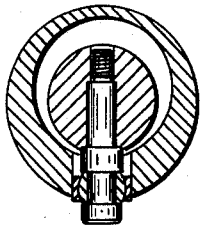

In FIG. 5, the inner eccentric has been rotated 180° from the FIG. 3 position to provide for minimum reciprocation. In this position the axes of the respective members are again aligned in a common plane, but the axis of the outer eccentric 58 is substantially coincident with the axis of the drive shaft 31 so that minimal motion will be imparted to the straps 66 and 74. To accommodate the further radial shifting of the outer eccentric it will be seen that the uni-ball assembly 61, 62 is now adjacent the outer end of the opening 64 of the outer eccentric. Although only three positions of the inner eccentric 45 have been illustrated, it will be understood that it is infinitely variable between the maximum and minimum positions to provide the precise amplitude of reciprocation required for any given set of conditions.

From the foregoing description it will be evident that the present invention provides a relatively simple, economical and yet highly effective vibrator mechanism for the ink drums of an inking mechanism which can be adjusted from one convenient and readily accessible position and wherein one adjustment serves to adjust the amplitude of reciprocation of a multiplicity of ink drums simultaneously.

I claim:

1. In an inking mechanism for a rotary printing press having at least one rotatable and axially displaceable ink drum and a plurality of coacting ink rollers the combination of vibrator means for axially reciprocating said ink drum comprising, a rotatable drive shaft adapted to be driven in synchronism with said press, a first eccentric telescoped over said drive shaft, a second eccentric telescoped over said first eccentric and being rotatable relative thereto, strap means mounted about said second eccentric and having a connection with said ink drum whereby upon rotation of said drive shaft and therewith said first and second eccentrics, reciprocating motion is imparted to said drum, means connecting said first eccentric to said drive shaft for positive rotation therewith, said connecting means being releasable to permit angular adjustment of the first eccentric relative to the drive shaft and to said second eccentric to thereby vary the extent of reciprocation of said ink drum, and second means connecting the second eccentric to said drive shaft for positive rotation therewith, said second connecting means permitting angular and radial shifting of said second eccentric relative to said drive shaft upon angular adjustment of said first eccentric.

2. An inking mechanism as set forth in claim 1 wherein said first eccentric is provided with an axially projecting sleeve that is concentric with said drive shaft and which extends to a remote position beyond the end of said drive shaft, said sleeve and thereby said drive shaft being journalled in bearing means for rotation about a fixed axis.

3. An inking mechanism as set forth in claim 2 wherein the projecting end of said sleeve is provided with diametrically opposite, axially extending slots for the reception of a tool whereby angular adjustments of said first eccentric relative to said drive shaft may be effected from a position remote from said first eccentric.

4. An inking mechanism as set forth in claim 2 wherein the means for connecting the first eccentric to the drive shaft comprises a circular disc, an internal shoulder formed in the projecting end of said sleeve, means connecting said disc to said drive shaft for rotation therewith, and means for compressing said disc against said internal shoulder to thereby drive said first eccentric.

5. An inking mechanism as set forth in claim 1 wherein said second eccentric projects axially beyond the first eccentric and the means for connecting the second eccentric to the drive shaft comprise a bolt mounted in the drive shaft with one end thereof projecting radially beyond the surface of the drive shaft, a uni-ball assembly mounted on the projecting end of said bolt, and an aperture in the projecting end of the second eccentric to slidably receive said uni-ball assembly.

6. In an inking mechanism for a rotary printing press having first and second rotatable and axially displaceable ink drums and a plurality of coacting ink rollers, the combination of vibrator means for axially reciprocating said ink drums comprising, a rotatable drive shaft adapted to be driven in synchronism with the press, a first eccentric telescoped over said drive shaft, a second eccentric telescoped over said first eccentric, a first strap means mounted about said second eccentric and having a connection with the first ink drum whereby upon rotation of the drive shaft and therewith said first and second eccentrics, reciprocating motion is imparted to said first ink drum, a second strap means mounted about said second eccentric and having a connection with the second ink drum whereby upon rotation of the drive shaft and therewith said first and second eccentrics, reciprocating motion is imparted to said second ink drum, said second strap means being disposed at an angle with respect to the first strap means whereby the second ink drum is reciprocated out of phase with respect to the first ink drum, releasable means for connecting the first eccentric to the drive shaft whereby angular adjustments of the first eccentric relative to the drive shaft and to the second eccentric can be effected to thereby vary the extent of reciprocation of said first and second ink drums, second means for connecting the second eccentric to said drive shaft for positive rotation therewith, said second connecting means permitting angular and radial shifting of the second eccentric relative to the drive shaft upon adjustment of said first eccentric, and means for adjusting said first eccentric from a remote position to thereby vary the extent of vibration of said first and second ink drums simultaneously while maintaining the predetermined phase relationship therebetween.

7. Inking mechanism as set forth in claim 6 further including a third rotatable and axially displaceable ink drum, and means connecting the second strap means to said third ink drum whereby the latter is reciprocated to the same extent but out of phase with respect to said first and second ink drums.

* * * * *